US005473799A

United States Patent [19]

Aoki

[11] Patent Number: 5,473,799

[45] Date of Patent: Dec. 12, 1995

[54] MAGNETIC CLOSURE DEVICE

[75] Inventor: Yoshihiro Aoki, Tokyo, Japan

[73] Assignee: Application Art Laboratories Co., Ltd., Tokyo, Japan

[21] Appl. No.: 200,525

[22] Filed: Feb. 23, 1994

[51] Int. Cl.[6] ..... A44B 21/00; H01F 7/00

[52] U.S. Cl. ..... 24/303; 24/66.1; 292/251.5; 335/285

[58] Field of Search ..... 24/303, 49 M, 24/94, 688; 335/285; 292/251.5; 70/459

[56] References Cited

U.S. PATENT DOCUMENTS

| | | | |
|---|---|---|---|
| 2,702,683 | 2/1955 | Green et al. | 335/285 |
| 2,806,396 | 9/1957 | Miller | 335/285 |
| 2,975,497 | 3/1961 | Budreck | 24/303 |
| 3,009,225 | 11/1961 | Budreck | 24/303 |
| 4,021,891 | 5/1977 | Morita | 24/303 |
| 4,265,002 | 5/1981 | Hosken | 24/303 |
| 4,480,361 | 11/1984 | Morita | 24/303 |
| 4,779,314 | 10/1988 | Aoki | 24/303 |

FOREIGN PATENT DOCUMENTS

| | | | |
|---|---|---|---|
| 3902289 | 8/1989 | Germany | 24/303 |
| 0105508 | 6/1983 | Japan | 335/285 |
| 1519246 | 7/1978 | United Kingdom | 292/251.5 |
| 2095321 | 9/1982 | United Kingdom . | |
| 2252593 | 8/1992 | United Kingdom | 292/251.5 |

*Primary Examiner*—Victor N. Sakran
*Attorney, Agent, or Firm*—Wenderoth, Lind & Ponack

[57] ABSTRACT

A magnetic closure device is configured to allow for a reduction in the magnetic gap as well as for adding mechanical strength to a cover for enclosing the magnet supply and other associated parts on one of two separate elements. The magnetic closure device includes a first element and a second element which are magnetically and mechanically coupled together and may be detached. The first element A includes an annular member formed to have a thick wall and mounted around the cover. The annular member includes ornamentation at its surface. The annular member may be formed from brass or other nonmagnetic materials, including plastics.

25 Claims, 7 Drawing Sheets

MAGNETIC CLOSURE DEVICE

BACKGROUND OF THE INVENTION

1. Field of the Invention

The present invention relates to a magnetic closure device, and more particularly to the combination of a first element containing a permanent magenet for providing a magnetic attracting action and a second element that is capable of being attracted by the first element, whereby the first and second elements may be coupled detachably. The device may be used to fasten a flap on a bag, handbag, and the like, or may provide the equivalent function of a button on clothing.

2. Description of the Prior Art

A device that makes use of the magnetic attraction of the permanent magnet and provides the functions as described above is known to the prior art, and such a device has various constructions which are also known. Typically, the construction that is known as making the most effective use of the magnetic action of the permanent magnet includes a first element that provides the magnetic attracting action and a second element that is capable of being attracted by the first element, wherein the first element includes a permanent magnet formed in a cylindrical shape having a center bore that provides a first polarity, a first ferromagnetic plate provided on the side of the first polarity and which optionally may have a first ferromagnetic rod extending therefrom, and a nonmagnetic covering which packages those parts as a unit, and wherein the second element includes a second ferromagnetic plate detachably attached to a second polarity of the permanent magnet and having a second ferromagnetic rod extending therefrom that disengageably engages the first ferromagnetic plate or optionally the rod thereof through the respective bores of the covering and permanent magnet. This construction is disclosed in Japanese Patent Application laid open No. 2 (1990)-105503 and U.S. Pat. No. 4,021,891, for example.

For the device of the type described above, some parts of the permanent magnet are exposed visibly from the outside, which is not desirable from the standpoint of its appearance. To avoid this, the permanent magnet is generally packaged in a covering that is formed from any nonmagnetic material such as brass in a thin cylindrical shape closed at the top.

It is noted, however, that the conventional device construction described above has one problem in forming the covering in a thin cylindrical shape closed at the top so as to incorporate the permanent magnet therein. When the permanent magnet is incorporated within such a covering, it creates a magnetic gap with regard to both the attracting side and the attracted side, thereby weakening the magnetic attracting force. In order to provide a strong magnetic attracting force in this case, it is necessary to provide a covering that is formed to be as thin as possible. If a covering is too thin, it might lose its mechanical strength. As the covering has the trade-offs between its mechanical strength and thickness, it must be formed to the thickness sufficient to ensure the mechanical strength. For this reason, the minimum thickness that can be achieved is limited to a certain value. It is also noted that the covering becomes larger as the device construction is larger, which imposes further limitations on forming the covering to as thin as possible without affecting its mechanical strength.

SUMMARY OF THE INVENTION

In light of the problems described above, it is an object of the present invention to provide a magnetic closure device that is configured to include a covering that meets a requirements for the reduced magnetic gap as well as for an increased mechanical strength.

The above object may be achieved by providing several different forms of the magnetic closure device according to the present invention.

In one aspect, the magnetic closure device includes a first element incorporating a permanent magnet for providing a magnetic attracting action, and a second element that is magnetically attracted by the first element and detachably coupled with the first element, wherein the first element further includes a thick annular member that is provided to cover the area of the first element other than the side of the first element attracting the second element and the side of the first element making contact with an object to which it is to be attached.

In another aspect, the magnetic closure device includes a first element that provides the magnetic attracting action and includes a permanent magnet formed in a cylindrical shape having a center bore and having a first ferromagnetic plate rigidly attached to a first polarity of the permanent magnet and a nonmagnetic covering that encloses the first element, and a second element that includes a second ferromagnetic plate that may be attracted by a second polarity of the permanent magnet and detachably coupled therewith through the covering, the second ferromagnetic plate having a second ferromagnetic rod extending therefrom and disengageably engaging directly the first ferromagnetic plate or a first ferromagnetic rod that optionally may be provided on the first ferromagnetic plate through the respective bores of the covering and permanent magnet, wherein the first element further includes an annular member formed from any nonmagnetic material to a thick cylindrical shape and which is securely mounted around the covering.

In a further aspect, the magnetic closure device includes a first element that provides the magnetic attracting action and includes a permanent magnet formed in a cylindrical shape having a center bore and having a first ferromagnetic plate rigidly attached to a first polarity of the permanent magnet and a nonmagnetic covering that encloses the first element, and a second element that includes a second ferromagnetic plate that may be attracted by a second polarity of the permanent magnet and detachably coupled therewith through the covering, the second ferromagnetic plate having a second ferromagnetic rod extending therefrom and disengageably engaging directly the first ferromagnetic plate or a first ferromagnetic rod that optionally may be provided on the first ferromagnetic plate through the respective bores of the covering and permanent magnet, wherein the covering includes an annular member having its side wall which is thick enough to support the mechanical strength of the covering.

It may be appreciated that one particular feature of the present invention is the provision of the thick annular member that supports the mechanical strength of the covering in the magnetic closure device. As another feature of the present invention, the side of the first element that attracts the second element is covered with a plate that is made as thin as possible, thereby reducing the magnetic gap that is created between the attracting side on the first element and the attracted side on the second element. And also, the plate may be provided with a hard material which is difficult to shape in processing.

BRIEF DESCRIPTION OF THE DRAWINGS

Those and other objects, features and merits of the present invention may be appreciated from the detailed description of several preferred embodiments that follows by reference to the accompanying drawings, in which.

DETAILED DESCRIPTION OF THE INVENTION

Figure 1:
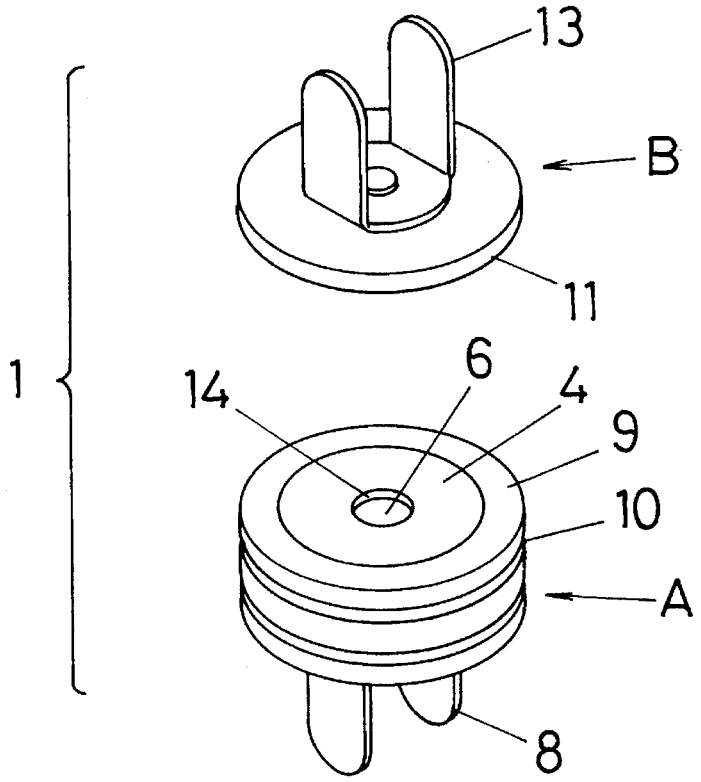
FIG. 1 is a perspective view illustrating a magnetic closure device according to a first embodiment of the present invention.
Figure 2:
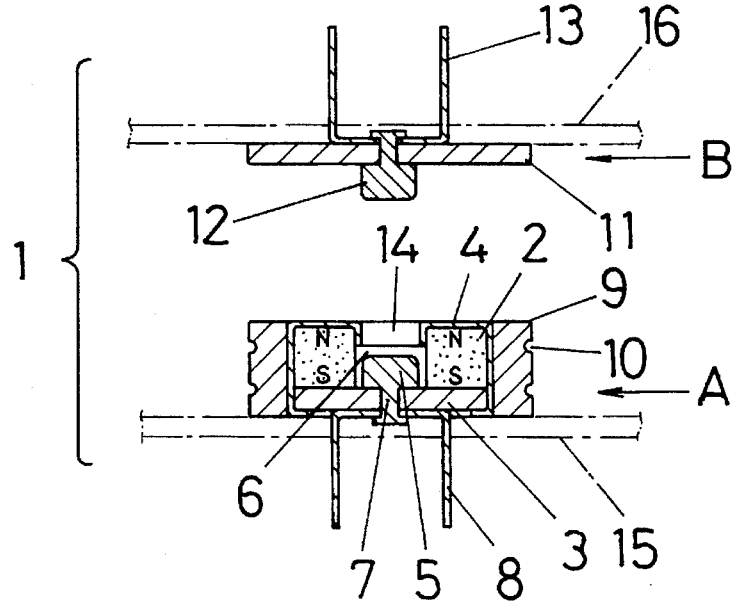
FIG. 2 is a sectional view of FIG. 1.

Referring to FIGS. 1 and 2, a magnetic closure device according to a first preferred embodiment is described. The device which is generally designated by reference numeral 1 includes a first element A (which provides the magnetic attraction) and a second element B (which is attracted by the element A). The first element A includes a permanent magnet 2, a first ferromagnetic plate 3 typically formed from an iron disc plate and attached to the S pole side of the permanent magnet 2, and a covering 4 formed in a cylindrical shape from a thin brass (typically 0.2 mm thick) and closed at the top for packaging the element A. The first ferromagnetic plate 3 includes a first ferromagnetic rod 5 (typically made of iron ) extending from a center of the plate 3 and having the length substantially equal to half the height of the permanent magnet 2. The first ferromagnetic rod 5 extends into a center bore 6 through the permanent magnet 2. The first ferromagnetic rod 5 further includes a shaft 7 which extends through the center of the first ferromagnetic plate 3 and is exposed from the plate 3. This shaft 7 is attached to a pair of legs 8 by press fit or any other means. Thus, the first ferromagnetic plate 3, the first ferromagnetic rod 5 and the pair of legs 8 form a unit. The pair of legs 8 may be used to fasten the first element A to an article such as a bag.

An annular member 9 formed in a cylindrical shape from a thick brass is rigidly mounted around the covering 4. The annular member 9 is formed to have its inner diameter substantially equal to the outer diameter of the covering 4, and its mounting to the covering 4 may be accomplished in different ways. For example, it may be mounted to the covering 4 by pressing the latter into the former, or by bonding both together. As shown, the annular member 9 includes two annular grooves 10 surrounding the outer circumference, which are provided for ornamental purposes. Those annular grooves 10 may be replaced by any other form and the surface ornament may be provided by cutting, stamping or the like. When the annular member 9 is die-cast, the surface ornament may be formed during the die-casting process, or may have any form such as circular and the like.

The second element B includes a second ferromagnetic plate 11 typically formed in a disc shape from iron and having a diameter substantially equal to the outer diameter of the annular member 9, a second ferromagnetic rod 12 typically formed from iron, and a pair of legs 13 that provides the same function as the pair of legs 8 on the first element A. The second ferromagnetic plate 11 is shown as having the same diameter as the annular member 9, but its diameter may be smaller than that shown in the example since making the diameter equal to the permanent magnet 2 is the minimum requirement. As for the first element A, those three parts form a unit. The second ferromagnetic rod 12 extends into a cylindrically-shaped center hole 14 in the top of the covering 4 and then into the center bore 6 of the permanent magnet 2 of the first element A. The second ferromagnetic rod 12 has a height such that it can meet the first ferromagnetic rod 5 of the first element A when the second ferromagnetic plate 11 engages the N-polarity side of the permanent magnet 2 through the top of the covering 4.

According to the magnetic closure device 1 described above, the first element A may be attached to a handbag body 15, for example, by fastening its pair of legs 8 to the body 15, and the second element B may be attached to the handbag flap 16 by fastening its pair of legs 13 to the flap 16. Closing the flap 16 brings the second ferromagnetic plate 11 closer to the N-polarity side of the permanent magnet 2 through the top of the covering 4. When the second ferromagnetic plate 11 engages the N-polarity side, the magnetic lines of force that emanate from the N polarity of the permanent magnet 2 flow through the second ferromagnetic plate 11, the second ferromagnetic rod 12, the first ferromagnetic rod 5 and the first ferromagnetic plate 3 into the S polarity side. It may be appreciated that the magnetic lines of force are centered in the first and second ferromagnetic rods 5 and 12, thus providing a greater magnetic attracting force. Then, this secures the flap 16 to the handbag body 15.

It may also be appreciated that the annular member 9 which is formed as a thick side wall can add mechanical strength to the permanent magnet 2 and first ferromagnetic plate 3. Thus, the covering 4 can be formed from any thin material, which provides the smaller magnetic gap and thereby increases the magnetic attraction force. As depicted in, for example, FIG. 2, the annular wall 9 is thus substantially thicker than the thin covering 4.

In addition, the annular member 9 may also serve an the ornamental purpose by providing the annular grooves 10 thereon. The portion of the surface of the first element A that is exposed when it is coupled with the second element B or not may be ornamented by the annular grooves 10. It should be appreciated that the annular grooves 10 shown in this embodiment may be replaced by any other form. Thus, individual devices may be customized to the particular user needs so that different units can have different patterns. Any damage or wrinkles that may occur on the covering 4 during the manufacturing process can advantageously be hidden by the annular member 9.

The annular member 9 may be formed from any nonmagnetic metals or plastics, and may have any ornamentation in the form of shapes or colors. Alternatively, the annular member 9 may be formed from any ferromagnetic materials such as iron, which provides a magnetic shielding function. The magnetic shield may be provided by interposing a cylindrical iron part between the annular member 9 and covering 4.

Figure 3:
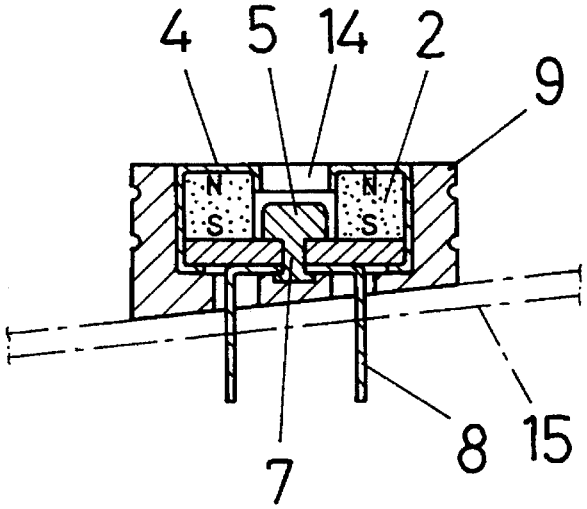
FIG. 3 is a sectional view illustrating a variation of an annular member in the magnetic closure device according to the first embodiment.

As shown in FIG. 3, the annular member 9 may be formed so that the height varies from one side toward the other, i.e., one side is higher than the other. In this way, the attracting side of the first element A can be fastened to the handbag body 15 at an angle relative to the body 15. For particular handbag or bag constructions, there are some cases in which parallelism cannot be maintained between the flap and body, depending upon the construction of the handbag or bag. In such cases, using the variation shown in FIG. 3 can help maintain the parallelism between those parts, without affecting the coupling power.

Figure 4:
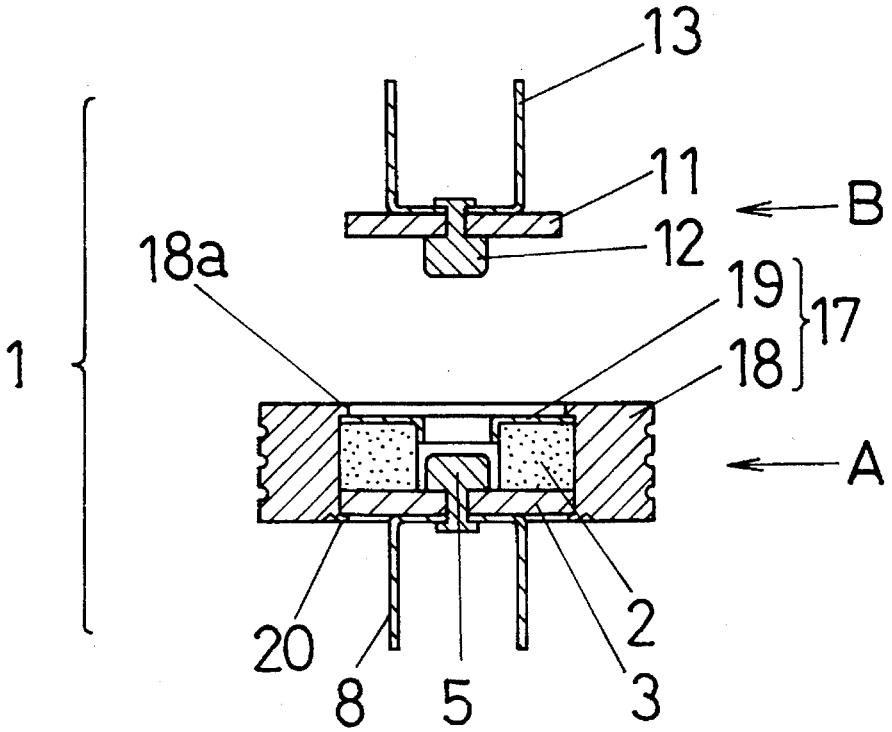
FIG. 4 is a sectional view illustrating the magnetic closure device according to a second embodiment of the present invention.
Figure 5:
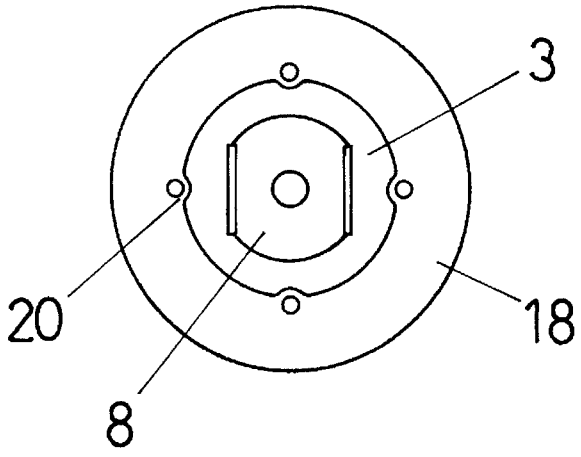
FIG. 5 is a bottom view of the device in the first embodiment.

FIG. 4 illustrates the second preferred embodiment of the present invention, wherein a covering 17 of the first element A includes a combination of an annular member 18 formed as a thick side wall and a disc plate 19. The annular member 18 includes an annular flange **18*a* extending inwardly on one side thereof (the upper side in the figure) and which engages the peripheral edge of the disc plate 19. The permanent magnet 2 and the first ferromagnetic plate 3 which are packaged within the covering 17 may be mounted inside the annular member 18 by inserting them one after the other from the opposite side of the annular member 18 (the bottom side in the figure). Then, the peripheral area of the annular member 18 surrounding its opening may be formed by striking like nails 20 at several appropriate locations, as shown in FIG. 5. Those nails 20 can hold the combination of the permanent magnet 2 and first ferromagnetic plate 3**.

Like the preceding embodiment, the annular member 18 adds mechanical strength to the covering 17. The disc plate 19 may be formed thin from any nonferromagnetic or ferromagnetic material. When it is made of the ferromagnetic material, it may eliminate the magnetic gap relative to the covering when the two elements A and B are coupled. Any hard metals, such as titanium, amorphous alloys and the like, that are difficult to be shaped may also be used. Those metals can protect the disc plate 19 against any damage or deformation that may be caused by the second ferromagnetic plate 12 the the second element B. The annular member 18 may be made of brass or plastic, as is the case for the preceding embodiment.

The portion of the annular member 18 that is exposed may be ornamented.

Figure 6:
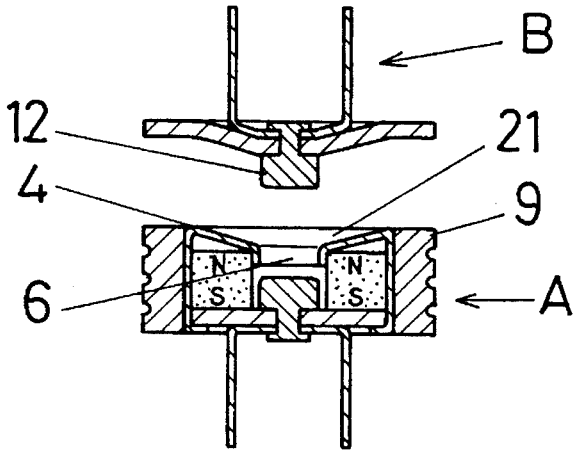
FIG. 6 is a sectional view illustrating the magnetic closure device according to a third embodiment of the present invention.

Referring now to FIG. 6, there is shown a third embodiment wherein an annular member 9 adds mechanical strength to the covering 4 and protects it.

According to the third embodiment, the covering 4 includes an enlarged entry portion 21 of the opening 6 at the top which aids the second ferromagnetic rod 12 of the element B in being guided into the center bore 6. This may reduce the mechanical strength, which can be supported by the annular member 9 that surrounds the enlarged portion 21.

Figure 18:
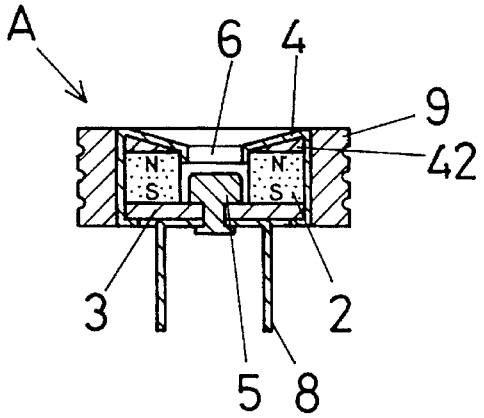
FIG. 18 is a partly sectional view illustrating a variation of the third embodiment shown in FIG. 6.
Figure 19:
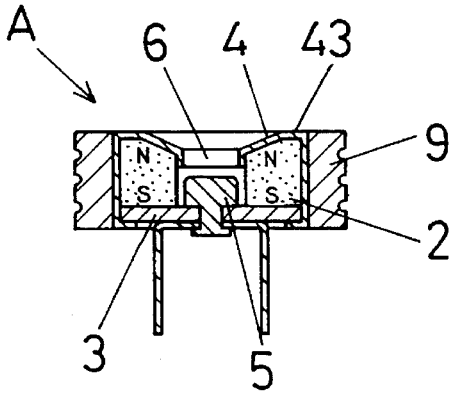
FIG. 19 is also a partly sectional view illustrating a further variation of the third embodiment.

It is to be noted that any voids between the permanent magnet 2 and the covering 4 may be filled by iron or other ferromagnetic materials 42 as shown in FIG. 18, or may be filled by a permanent magnet 2 formed appropriately as shown in FIG. 19. For the latter case, the permanent magnet 2 may be formed to include a flat peripheral margin 43.

Figure 7:
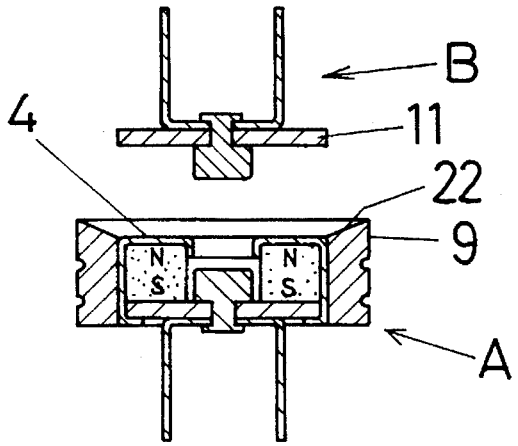
FIG. 7 is a sectional view illustrating the magnetic closure device according to a fourth embodiment of the present invention.

FIG. 7 shows a fourth embodiment in which the annular member 9 provides the function of guiding the rod on the element B into the element A.

Specifically, the annular member 9 is formed to be greater in height than the covering 4, and the portion of the annular member 9 located above the covering 4 includes a taper 22 inside. This aids the second ferromagnetic plate 11 of the element B in being attracted to the element A.

FIGS. 8 through 13 illustrate respective embodiments wherein means for engaging the two elements A and B is provided, respectively.

Figure 8:
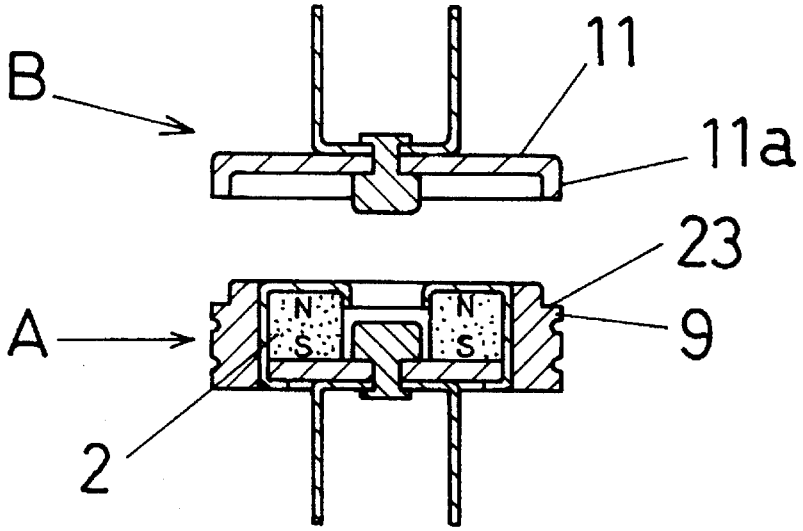
FIG. 8 is a sectional view illustrating the magnetic closure device according to a fifth embodiment of the present invention.

In FIG. 8, the means includes a combination of a reduced diameter shoulder 23 around the upper outer peripheral edge of the annular member 9 on the first element A, and an annular flange **11*a* extending downwardly from the second ferromagnetic plate 11** of the second element B. Those two parts may engage each other.

When the second element B is attracted to the first element A, the annular flange **11*a* on the second ferromagnetic plate 11 engages the correponding shoulder 23 on the annular member 23. If any attempt is made to detach an elements A and B, the effort that can overcome the resultant force of the magnetic attraction of the permanent magnet 2 and frictional force between the annular flange 11*a* and shoulder 23** would be required. Thus, there is no risk that those elements will be detached inadvertently.

Figure 9:
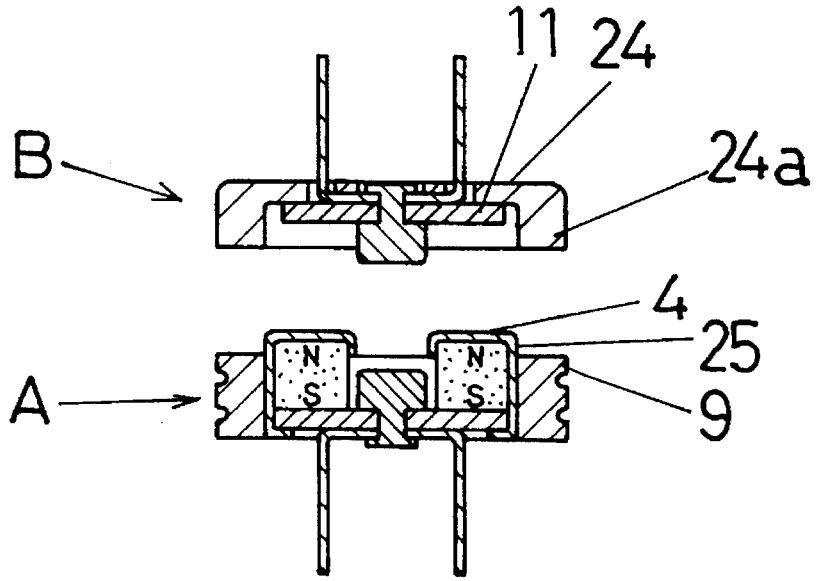
FIG. 9 is a sectional view illustrating the magnetic closure device according to a sixth embodiment of the present invention.
Figure 10A:
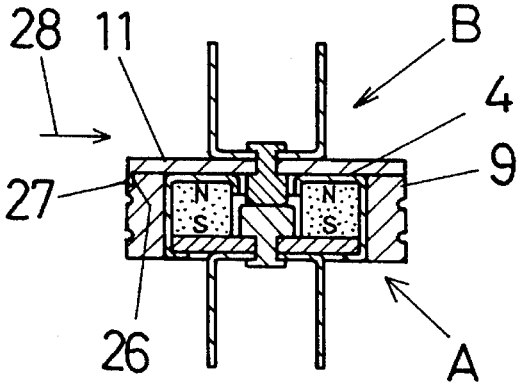
FIG. 10*a* is a sectional view illustrating the magnetic closure device according to a seventh embodiment of the present invention.
Figure 10B:
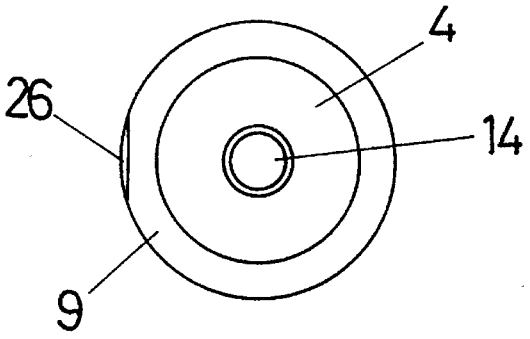
FIG. 10*b* is a plan view showing a first element (i.e., an element which provides magnetic attraction) of the seventh embodiment.

In FIG. 9, the annular member 9 is formed to be lower in height than the covering 4, and a reduced diameter shoulder 25 is provided by the combination of the covering 4 and annular member 9.

Correspondingly, the second ferromagnetic plate 11 on the second element B includes a cap 24 having a flange **24*a* extending downwardly and which engages the shoulder 25**. Thus, the elements A and B can be coupled securely.

In a seventh embodiment shown in FIGS. **10*a* and 10*b*, the annular member 9 includes a recess 26 formed on the upper outer edge thereof, and correspondingly, the second ferromagnetic plate 11 of the second element B includes a projection 27 extending downwardly from the outer peripheral edge in one side and can engage the recess 26 on the annular member 9**.

According to this embodiment, any effort that would be attempted to move the projection 27 in the direction of an arrow 28 could be cancelled by the combined force of the magnetic attraction of the permanent magnet 2 and the force of the engaged recess 26 and projection 27. Thus, when this situation occurs, the elements A and B will not be detached. The two opposed forces may be cancelled by aligning the direction of any applied effort with the direction of the arrow 28.

Figure 11:
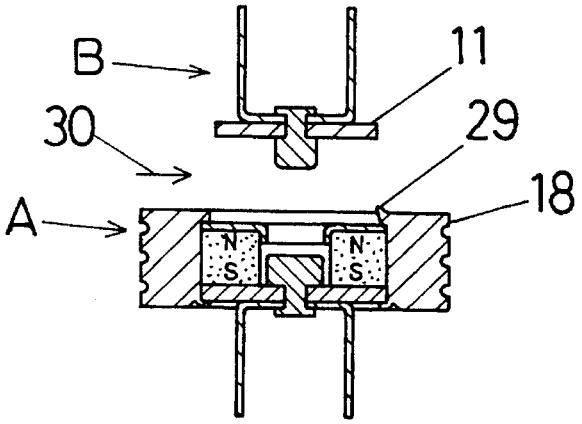
FIG. 11 is a sectional view illustrating the magnetic closure device according to an eighth embodiment of the present invention.

In an eighth embodiment shown in FIG. 11, the annular member 18 includes a protruded part 29 extending upwardly from the upper inner periphery thereof. The protruded part 29 is provided for engaging the peripheral wall of the second ferromagnetic plate 11 on the second element B, and any effort that would be attempted to move the protruded part 29 in the direction of an arrow 30 could be cancelled by the combined force of the engaged second ferromagnetic plate 11 and protruded part 29. Any effort that is applied in the direction of the arrow 30 can effectively be cancelled.

Figure 12:
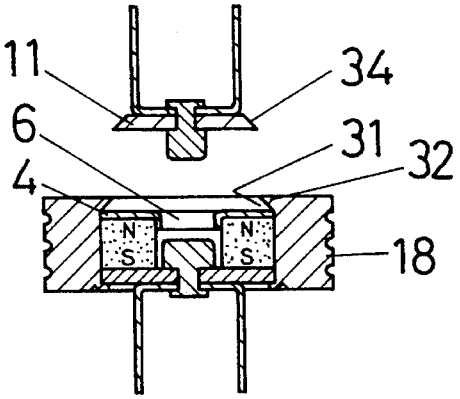
FIG. 12 is a sectional view illustrating the magnetic closure device according to a ninth embodiment of the present invention.
Figure 13:
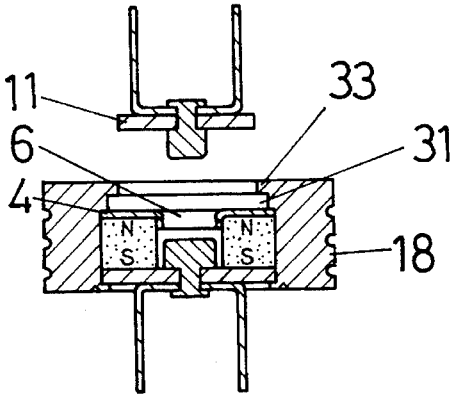
FIG. 13 is a sectional view illustrating the magnetic closure device according to a tenth embodiment of the present invention.

FIG. 12 and FIG. 13 illustrate respective embodiments wherein the annular member 18 includes a circular groove 31 formed between the upper inner periphery thereof and the covering 4 so that the circular groove 31 can engage the second ferromagnetic plate 11 on the element B having the shape matching the shape of the circular groove 31. Specifically, in FIG. 12, the annular member 18 includes a circular protrusion 32 having a triangular shape in cross section which is formed around the upper inner periphery. In FIG. 13, the annular member 18 includes stepped circular protrusion 33. Correspondingly, the second ferromagnetic plate 11 in FIG. 12 includes a taper 34 on the outer periphery thereof, and a second ferromagnetic plate 11 in FIG. 13 is formed to have the thickness that is substantially equal to the height of the annular groove 31.

Usually, a certain clearance exists between the second ferromagnetic rod 12 and the wall of the center hole 6 to allow for the second ferromagnetic rod 12 to move laterally when it is located in the center hole 6. Any effort that may be applied to the second element B causes a second ferromagnetic plate 11 to slide laterally the distance equal to the clearance. When this occurs, the second ferromagnetic plate 11 will be locked immovably by having its peripheral edge enter the circular groove 31. This supplements the magnetic attraction of the magnet 2, thereby increasing the locking ability.

A need for reducing the magnetic gap arises when more attracting force from the permanent magnet is required. When a powerful permanent magnet is used, any reduction in the magnetic gap may have the adverse effect. When the elements A and B are separated, the magnetic lines of force that appear on the attracting side of the element A might affect a magnetic card, magnetic tape or other magnetic recording medium, destroying any information recorded thereon.

When such powerful permanent magnet is used, the magnetic attraction between the elements A and B will remain unchanged even if the magnetic gap is greater.

FIGS. 14 through 17 illustrate respective embodiments wherein the required magnetic attraction can be obtained without affecting the magnetic recording medium.

Figure 14:
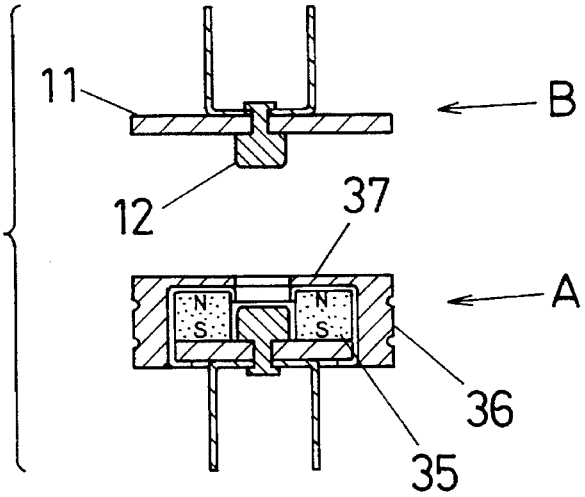
FIG. 14 is a sectional view illustrating the magnetic closure device according to an eleventh embodiment of the present invention.

According to the embodiment of FIG. 14, a powerful permanent magnet 35 is used in place of the permanent magnet 2. An annular member 36 a thick outer wall and a control plate 37 that produces a magnetic gap relative to the attracted side of the element B. The control plate 37 functionally shields any magnetic recording medium against the magnet 39, protecting it against any possible information destruction and, as depicted in FIG. 14, the outer wall of the member 36 is substantially thicker than the control plate 37.

Figure 15:
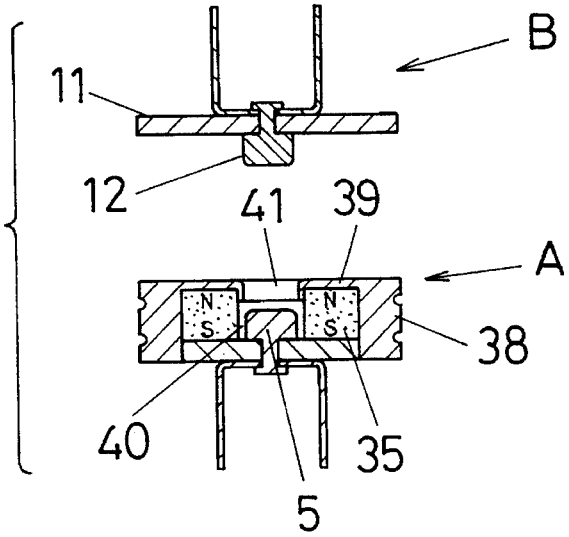
FIG. 15 is a sectional view illustrating the magnetic closure device according to a twelfth embodiment of the present invention.

In the embodiment of FIG. 15, a powerful permanent magnet 35 is also used in place of the permanent magnet 2, and the covering 4 is omitted. Instead, the annular member 38 also acts as the covering 4. In this case, the annular member includes a control plate 39 that is functionally equivalent to the control plate 37 in FIG. 14, and a cylindrical recess 41 which is accommodated within the center hole 40 of the magnet 35. This construction also protects any magnetic recording medium against any possible information destruction.

Figure 16:
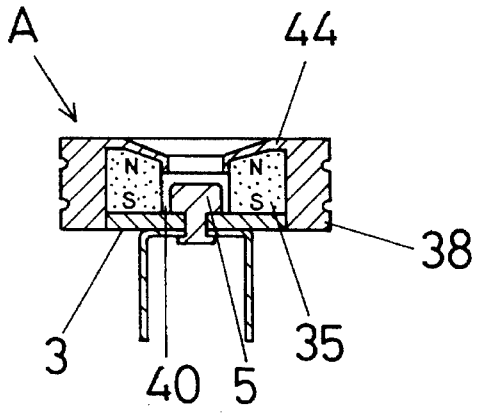
FIG. 16 is a partly sectional view illustrating a variation of the twelfth embodiment shown in FIG. 15.
Figure 17:
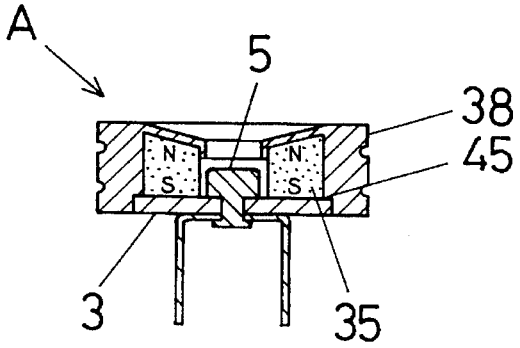
FIG. 17 is also a partly sectional view illustrating a further variation of the twelfth embodiment.

Variations of the embodiment in FIG. 15 are shown in FIGS. 16 and 17, respectively. In both FIG. 16 and FIG. 17, the attracting side of the element A is formed to include a recess that is configured like the recess in FIG. 6 and is functionally equivalent to it. This recess aids the second ferromagnetic rod 12 in being guided into the center hole 40. As shown in FIG. 16, the powerful permanent magnet 35 may be configured to include a flat portion 44 matching the shape of the annular member 38, and the distance between the upper end of the annular member 38 and the upper end of the first ferromagnetic rod 5 may be determined appropriately. As shown in FIG. 17, the annular member 38 may include an annular shoulder 45 at the bottom end that can engage the first ferromagnetic plate 3, and the distance between the upper end of the annular member 38 and the upper end of the first ferromagnetic rod 5 may be determined appropriately.

According to the various embodiments and variations thereof that have been described so far, the thick annular member adds mechanical strength to the covering. Thus, the magnetic gap can be reduced, and the magnetic attracting force can be increased accordingly. The annular member provides a mechanical locking function, and also aids the second element B in being guided into the first element A. Also, an annular member provides the ornamental function.

In addition, the control plate that is provided in the annular member can protect any magnetic recording medium from its possible exposure to the magnetism by shielding it.

Although the present invention has been described in conjunction with the preferred embodiments and variations thereof, it should be understood that various changes and modifications may be made without departing from the spirit and scope of the invention as defined in the appended claims.

What is claimed is:

1. A magnetic closure device comprising:

a magnetically attracting first element;

a magnetically attractable second element comprising a ferromagnetic plate;

wherein said first element comprises a cylindrical magnet having a central axial bore and first and second axial ends respectively with first and second opposite polarities, a ferromagnetic plate fixed to said first end of said cylindrical magnet, a ferromagnetic rod extending from said ferromagnetic plate of said first element into said central axial bore of said cylindrical magnet, an annular cover member covering said second axial end of said cylindrical magnet, and an annular cylindrical wall fixedly mounted around said cylindrical magnet; and wherein said annular cylindrical wall is substantially thicker than said annular cover member.

2. A magnetic closure device as recited in claim 1, wherein said annular cylindrical wall is formed of plastic.

3. A magnetic closure device as recited in claim 1, wherein said annular cylindrical wall is formed of metal.

4. A magnetic closure device as recited in claim 1, wherein ornamentation is provided at a periphery of said annular cylindrical wall of said first element.

5. A magnetic closure device as recited in claim 1, wherein said annular cylindrical wall has a gradually increasing height from a first peripheral location thereof to a second peripheral location thereof diametrically opposite said first peripheral location.

6. A magnetic closure device as recited in claim 1, further comprising means for guiding said second element toward said second end of said cylindrical magnet.

7. A magnetic closure device as recited in claim 1, wherein said annular cover member is inclined in a direction downwardly and radially inwardly into said central axial bore of said cylindrical magnet.

8. A magnetic closure device as recited in claim 7, wherein said annular cover member is integral with said annular cylindrical wall.

9. A magnetic closure device as recited in claim 1, wherein an end of said annular cylindrical wall adjacent said second end of said cylindrical magnet is inclined in a direction downwardly and radially inwardly toward said central axial bore of said cylindrical magnet.

10. A magnetic closure device as recited in claim 1, wherein said annular cylindrical wall includes means for mechanically retaining said second element in engagement with said first element.

11. A magnetic closure device as recited in claim 1, wherein said annular cylindrical wall has a reduced diameter shoulder at an end thereof adjacent said second end of said cylindrical magnet; and said ferromagnetic plate of said second element includes an annular flange depending from a periphery thereof, said annular flange being engageable about said reduced diameter shoulder of said annular cylindrical wall.

12. A magnetic closure device as recited in claim 1, wherein said second end of said cylindrical magnet extends beyond said annular cylindrical wall so as to constitute a reduced diameter shoulder of said first element; and said ferromagnetic plate of said second element includes an annular flange depending from a periphery thereof, said annular flange being engageable about said reduced diameter shoulder of said annular cylindrical wall.

13. A magnetic closure device as recited in claim 1, wherein said annular cylindrical wall has a recess formed at an outer periphery thereof; and said ferromagnetic plate of said second element includes a projection depending from a periphery thereof, said projection being engageable in said recess of said annular cylindrical wall.

14. A magnetic closure device as recited in claim 1, wherein said annular cylindrical wall includes an inwardly directed annular flange extending over a peripheral portion of said annular cover member.

15. A magnetic closure device as recited in claim 1, wherein said annular cylindrical wall includes a protruding part protruding radially inwardly and upwardly above said second end of said cylindrical magnet.

16. A magnetic closure device as recited in claim 1, wherein said annular cylindrical wall includes a radially inwardly extending annular protrusion extending over said second end of said cylindrical magnet so as to define a circular groove between said annular protrusion and said second end of said cylindrical magnet.

17. A magnetic closure device as recited in claim 16, wherein said annular protrusion comprises a tapered annular protrusion.

18. A magnetic closure device as recited in claim 16, wherein said annular protrusion comprises a stepped annular protrusion.

19. A magnetic closure device as recited in claim 1, wherein said annular cover member is integral with said annular cylindrical wall.

20. A magnetic closure device as recited in claim 1, wherein said ferromagnetic rod of said first element extends in said central axial bore of said cylindrical magnet to approximately half the height of said cylindrical magnet.

21. A magnetic closure device as recited in claim 1, wherein said second element further includes a ferromagnetic rod extending from said ferromagnetic plate of said second element and being sized to be insertable into said central axial bore of said cylindrical magnet of said first element.

22. A magnetic closure device as recited in claim 1, further comprising a covering member including a cylindrical sidewall interposed between said cylindrical magnet and said annular cylindrical wall, a first annular end wall extending from one end of said cylindrical sidewall and radially inwardly beneath said ferromagnetic plate of said first element, and a second annular end wall extending from another end of said cylindrical sidewall and radially inwardly therefrom.

23. A magnetic closure device as recited in claim 22, wherein said second annular end wall of said covering member constitutes said annular cover member.

24. A magnetic closure device as recited in claim 1, wherein said ferromagnetic rod of said first element extends into and terminates within said central axial bore of said cylindrical magnet.

25. A magnetic closure device as recited in claim 1, wherein a thickness of said annular cover member constitutes an entirety of a magnetic gap between said second end of said cylindrical magnet and said ferromagnetic plate of said second element when said second element is engaged with said first element.

* * * * *